US011390363B2

(12) United States Patent
Barnes et al.

(10) Patent No.: US 11,390,363 B2
(45) Date of Patent: Jul. 19, 2022

(54) BOAT LIFT

(71) Applicants: Sean A. Barnes, Mt. Pleasant, SC (US); Michael W. Kirby, Mt. Pleasant, SC (US)

(72) Inventors: Sean A. Barnes, Mt. Pleasant, SC (US); Michael W. Kirby, Mt. Pleasant, SC (US)

( * ) Notice: Subject to any disclaimer, the term of this patent is extended or adjusted under 35 U.S.C. 154(b) by 283 days.

(21) Appl. No.: 16/843,491

(22) Filed: Apr. 8, 2020

(65) Prior Publication Data

US 2021/0316830 A1 Oct. 14, 2021

(51) Int. Cl.
*B63C 1/06* (2006.01)

(52) U.S. Cl.
CPC ..... *B63C 1/06* (2013.01)

(58) Field of Classification Search
CPC ..... B63C 1/02; B63C 1/06; B63C 1/12
USPC ..... 114/263, 264, 266, 267, 45; 441/35
See application file for complete search history.

(56) References Cited

U.S. PATENT DOCUMENTS

| | | | |
|---|---|---|---|
| 3,074,239 A | 1/1963 | Mustard | |
| 3,270,698 A | 9/1966 | Fort | |
| RE27,090 E | 3/1971 | Rutter | |
| 3,603,276 A | 9/1971 | De Lisle | |
| 3,727,415 A | 4/1973 | Williams | |
| 3,967,570 A | 7/1976 | Bradfield | |
| 4,018,179 A | 4/1977 | Rutter | |
| 4,072,119 A | 2/1978 | Williams | |
| 4,276,849 A | 7/1981 | Bloxham | |
| 4,280,429 A | 7/1981 | Wells | |
| 4,510,877 A | 4/1985 | Bloxham | |
| 4,641,595 A | 2/1987 | Pritchett | |
| 4,763,592 A | 8/1988 | Russ | |
| 4,782,778 A | 11/1988 | Barbaglia | |
| 5,002,000 A | 3/1991 | Rutter | |
| 5,016,551 A | 5/1991 | Peck et al. | |
| 5,046,897 A | 9/1991 | Ray | |
| 5,140,922 A | 8/1992 | Bowman et al. | |
| 5,394,814 A | 3/1995 | Rutter et al. | |
| 5,549,070 A | 8/1996 | Cruchelow et al. | |
| 5,664,513 A | 9/1997 | Echelbarger | |
| 5,826,528 A | 10/1998 | Jancsek | |
| 5,845,594 A * | 12/1998 | Hallsten | B63B 35/38 114/263 |
| 5,860,379 A | 1/1999 | Moody | |
| 5,860,765 A | 1/1999 | Cruchelow et al. | |
| 6,145,463 A | 11/2000 | Zeilinger | |
| 6,179,525 B1 | 1/2001 | Gruhn et al. | |
| 6,477,968 B2 | 11/2002 | Powell | |

(Continued)

FOREIGN PATENT DOCUMENTS

| | | |
|---|---|---|
| DE | 2042850 | 3/1972 |
| FR | 3017595 | 6/2014 |
| WO | WO2014035026 | 3/2014 |

*Primary Examiner* — Daniel V Venne
(74) *Attorney, Agent, or Firm* — B. Craig Killough

(57) ABSTRACT

A boat lift has pumps that evacuate water from flotation containers lower the boat lift. Multiple flotation containers are retained by a frame that is formed as a grid. The pumps are contained within a housing that is retained in position by the frame. Water enters the housing through valves and is distributed to the flotation containers to lower the boat lift. Water is evacuated from the flotation containers by pumps, with valves closed to prevent water from entering the flotation containers.

17 Claims, 5 Drawing Sheets

(56) References Cited

U.S. PATENT DOCUMENTS

| | | | | |
|---|---|---|---|---|
| 6,526,902 | B1 | 3/2003 | Faber | |
| 6,547,485 | B2 | 4/2003 | Elson | |
| D506,668 | S | 6/2005 | Black | |
| 7,153,064 | B2 | 12/2006 | Zeilinger et al. | |
| 7,390,141 | B2 | 6/2008 | Rytand | |
| 7,406,924 | B1 | 8/2008 | Impey | |
| 7,640,881 | B1 * | 1/2010 | Gerst | B63B 3/08 114/263 |
| 7,845,300 | B1 * | 12/2010 | Stroud | B63B 35/44 114/263 |
| 8,267,621 | B1 | 9/2012 | Way | |
| 8,292,547 | B2 * | 10/2012 | Johanneck | B63C 1/02 114/263 |
| 8,739,726 | B2 * | 6/2014 | Mann | E01D 15/14 114/263 |
| 9,132,897 | B2 | 9/2015 | Barnes et al. | |
| 9,352,812 | B1 | 5/2016 | Barnes et al. | |
| 9,487,925 | B1 | 11/2016 | Meriweather et al. | |
| 9,604,709 | B2 | 3/2017 | Barnes | |
| D826,702 | S | 8/2018 | Barnes et al. | |
| D828,746 | S | 9/2018 | Barnes et al. | |
| D828,747 | S | 9/2018 | Barnes et al. | |
| 10,086,919 | B2 | 10/2018 | Barnes | |
| D837,041 | S | 1/2019 | Barnes et al. | |
| 10,267,003 | B2 | 4/2019 | Barnes et al. | |
| 10,370,073 | B2 | 8/2019 | Barnes | |
| 2002/0131821 | A1 | 9/2002 | Elson | |
| 2005/0002741 | A1 | 1/2005 | Brensinger et al. | |
| 2005/0271477 | A1 | 12/2005 | Sehl | |
| 2006/0156964 | A1 | 7/2006 | Canniffe et al. | |
| 2007/0248420 | A1 | 10/2007 | Jacobs et al. | |
| 2008/0014028 | A1 | 1/2008 | Faires et al. | |
| 2008/0276851 | A1 | 11/2008 | Weed | |
| 2008/0306642 | A1 | 12/2008 | Figura et al. | |
| 2009/0235857 | A1 | 9/2009 | Hodapp | |
| 2011/0146554 | A1 | 6/2011 | Wright et al. | |
| 2011/0274502 | A1 | 11/2011 | Tibedo et al. | |
| 2011/0277675 | A1 | 11/2011 | Thom et al. | |
| 2014/0010593 | A1 | 1/2014 | Davis | |

* cited by examiner

BOAT LIFT

BACKGROUND OF THE INVENTION

It is desirable to store boats out of the water when not in use. Particularly in saltwater environments, water can lead to rapid corrosion of metal parts, and depreciation of other parts of the boat. Further, in many saltwater environments, storage of the boat hull in the water leads to fouling of the hull, propellers and through hulls that communicate with boat utilities. Barnacle growth, for example, occurs in many saltwater environments, and such fouling reduces performance of the boat hull and propulsion systems. It is also desirable to lift boats out of the water for maintenance and cleaning.

There is also a need for a floating boat dock that is easy to assemble, yet is efficient in its operation. The floating dock should also be easy to repair in the event of damage to flotation elements.

SUMMARY OF THE INVENTION

A boat lift has pumps that evacuate water from flotation containers to lower the boat lift, and valves that allow water to selectively enter the flotation containers to submerge the boat lift. Multiple flotation containers are retained by a frame that is formed as a grid. The pumps are contained within a housing retained in position by the frame. The frame formed as a grid and the multiple flotation containers provide a boat lift that is convenient to assemble, and the multiple flotation containers allow flexibility in design and construction. Individual, small flotation containers may be replaced in the event of damage without a need to repair or replace large components.

BRIEF DRAWING DESCRIPTION

DESCRIPTION OF PREFERRED EMBODIMENTS

Figure 4:
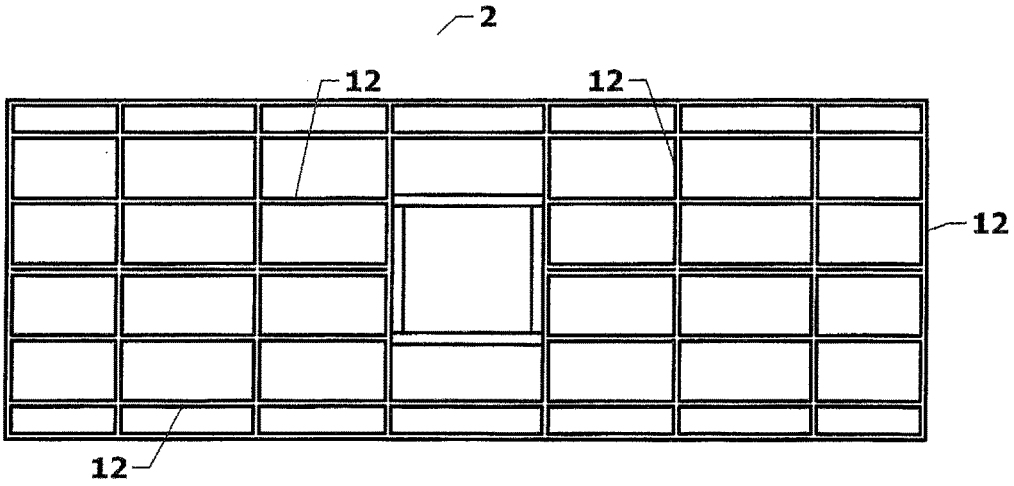
FIG. 4 is a top plan view of the frame of the boat lift formed as a grid.

FIG. 4 shows a frame 2 for the boat lift according to a preferred embodiment of the invention. The frame is formed as a grid or lattice comprising a framework of spaced structural members 12 that cross each other. The frame provides structural support for a boat and a frame for positioning and holding a plurality of floatation containers 4.

The structural members are preferred to be formed of rigid materials that will resist corrosion associated with water environments. A material that is useful for forming bars and the frame is aluminum.

Figure 7:
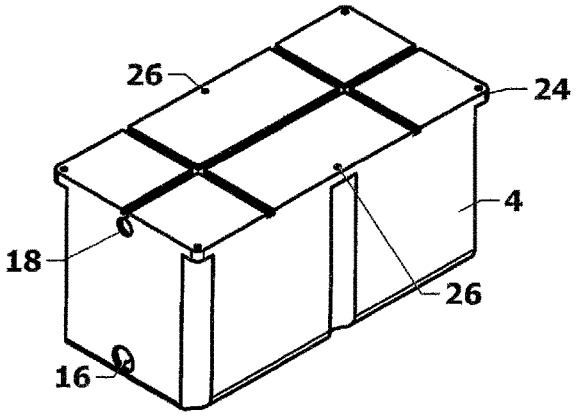
FIG. 7 is a perspective view of a flotation container that is representative of the plurality of flotation containers positioned with in the grid of the frame.

A plurality of floatation containers 4 are positioned below the structural members and attached to the frame 2. An example of a single floatation container is shown in FIG. 7. The floatation containers are preferred to be formed as a unit that is watertight. Optionally, and as shown in the example of FIG. 7, one or more openings may be formed in the flotation container. As will be further described, a lower opening 16 provides an opening in the flotation container for communication with a pump housing 28 by a water transfer hose. A connection for the water transfer hose may be provided at the opening. The upper opening 18 is connected to a vent line 22 that extends above the water line when the floating dock of the invention is positioned in the water. Vent line 22 facilitates purging air from the flotation container, or it facilitates air entering into the flotation container during operation of the floating dock. The flotation container may have holes 26 formed within tabs 24 that allow the flotation container to be bolted or otherwise fastened to the frame.

It is preferred that the flotation containers 4 are attached underneath the structural members of the frame 2 to reduce the likelihood of the flotation containers breaking loose from the frame as they are emptied of water and float. When the flotation members are substantially emptied of water and float, they push upwardly against the structural members if attached below the structural members, rather than pulling away from the structural members as they would if attached over the structural members.

In an embodiment of the boat lift, the top surface of the frame 2 is substantially flat, and the bottom surface of the frame is substantially flat. The frame is inverted during manufacturing, and place on a substantially level surface, such as a floor. The relatively small individual flotation containers 4 can be conveniently attached to the bottom of the frame, and under the frame. The plurality of flotation containers are sufficient in number to lift the boat, without the use of large and difficult to handle and position flotation tanks. The tops of the plurality of flotation containers are in the same plane. Tanks are not mounted at an angle, which is beneficial in construction of the boat lift, and promotes even filling and evacuation of the flotation tanks.

Figure 1:
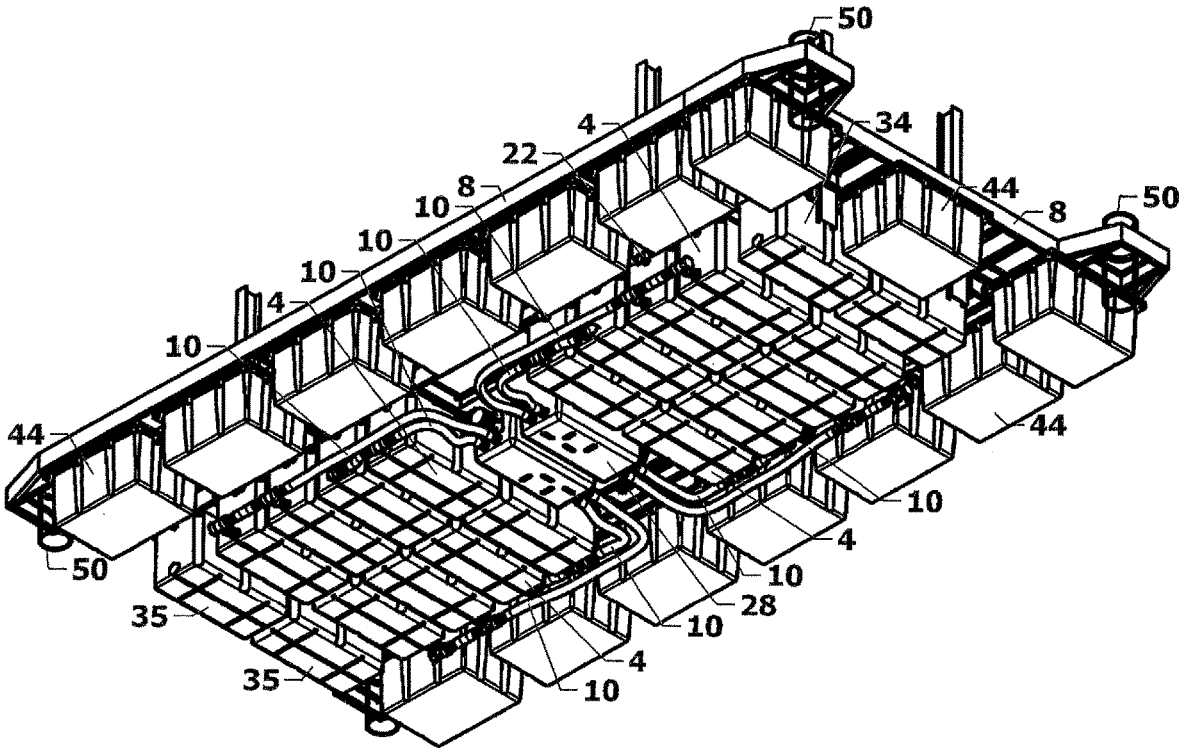
FIG. 1 is a perspective view of a boat lift and catwalk according to an embodiment of the invention emphasizing the bottom of the boat lift and catwalk.
Figure 2:
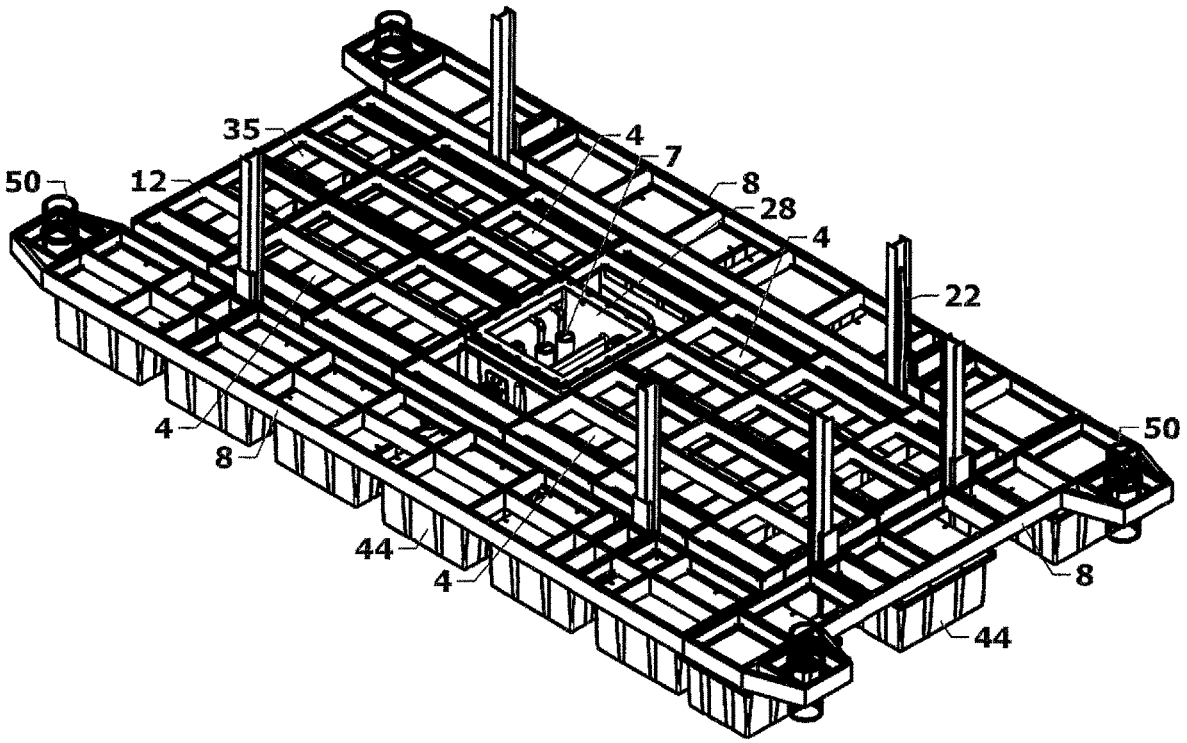
FIG. 2 is a perspective view of the boat lift and catwalk emphasizing the top of the boat lift and catwalk of FIG. 1.
Figure 3:
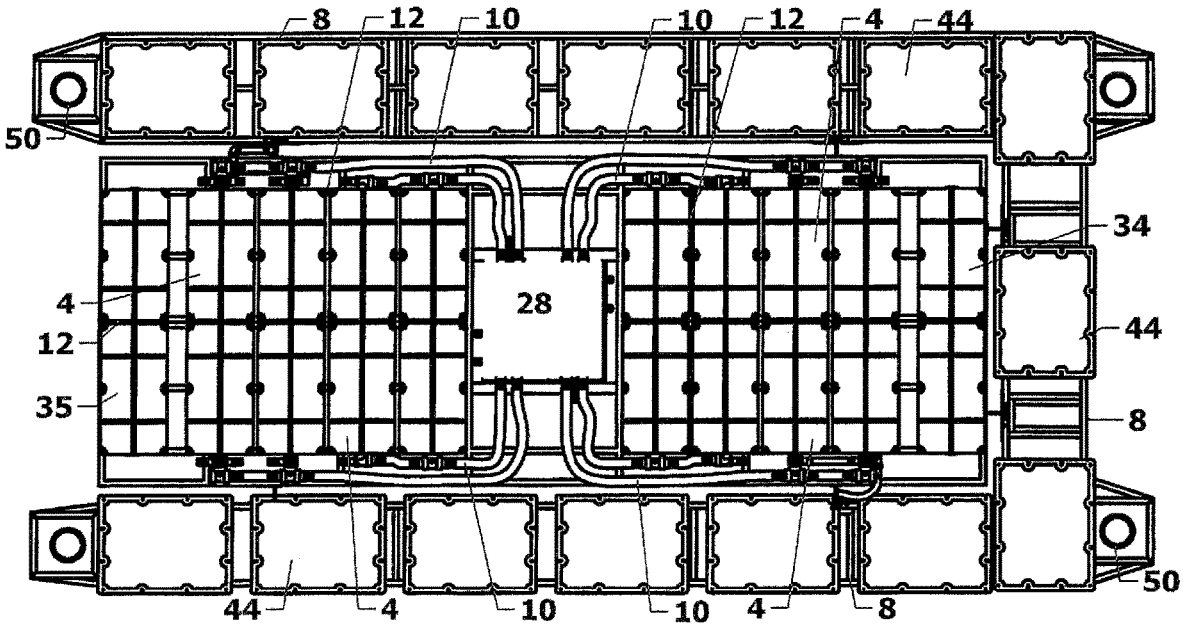
FIG. 3 is a top plan view of the boat lift and catwalk of FIG. 1.

FIG. 1 shows the boat lift according to an embodiment of the invention in an assembled form. In this particular embodiment, a catwalk 8 surrounds the boat lift on three sides, although the catwalk could surround the boat lift on one or two sides. A plurality of flotation containers 4 is inserted into the frame of the boat lift. As shown in FIG. 1, eight flotation containers are positioned in a front portion of the boat lift and eight flotation containers are positioned in a rear portion of the boat lift. These flotation containers are flooded to lower the boat lift and evacuated to raise the boat lift. The number of flotation containers that are employed is dependent on the size of the flotation containers and the desired lift capacity of the boat lift. However, it is preferred that at least two flotation containers are present in each quadrant of the boat lift to provide balancing of the boat lift as it is loaded with a vessel. Further, by using at least two flotation containers in each quadrant of the boat lift, in the event of damage to a flotation container, the boat lift still provides lifting capacity. The boat lift may be raised by the normal operation of the boat lift for convenient replacement of a damaged flotation container.

As shown in FIG. 1, eight of the flotation containers 4 are positioned near the rear of the boat lift and communicate with the rear section of pump housing 28, and the eight flotation containers positioned near the front portion of the boat lift communicate with the front section of pump housing 28. Water transfer hoses 10 that connect the flotation containers to the pumps housing 28 are also shown in FIG. 1. Vent lines 22 that allow air to enter or evacuate the flotation containers are also present.

In an embodiment as shown in FIG. 1, the two flotation containers 34 at the front of the boat lift and the two flotation containers positioned 35 at the rear or aft of the boat lift do not communicate with the pump housing 28. These flotation containers may be filled with a foam material and provide some flotation for the boat lift. The use of these flotation containers is optional. The flotation containers are sealed so that water does not enter the flotation containers, and there is no provision for flooding or evacuating water from these flotation containers. The number of flotation containers, both those that communicate with the pumps housing 28, and those that do not communicate with the pumps housing 28, as well as the size of the frame that accommodates the flotation containers, is dependent upon the application. Similarly, the size of the flotation containers is dictated by the application, and the size of the flotation containers will in turn dictate the dimensions of the grid that is formed by the frame.

Generally, the larger the boat or boats to be positioned on top of the boat lift will dictate the number of flotation containers 4 and the size of the flotation containers to be used. In a preferred embodiment, the flotation containers are formed of polyethylene, although other noncorrosive materials that will form a watertight container may be used. The overall specific gravity of the completed boat lift construct, when the flotation containers are substantially emptied of water by the pumps, is less than 1.0 so that the boat lift floats when water is evacuated from the flotation containers.

Figure 8:
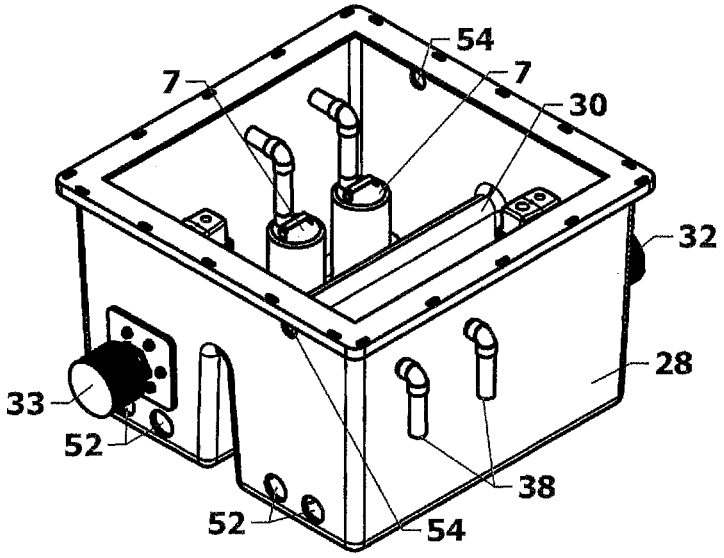
FIG. 8 is a perspective view of a pump housing and pump construct positioned within the grid of the frame.
Figure 9:
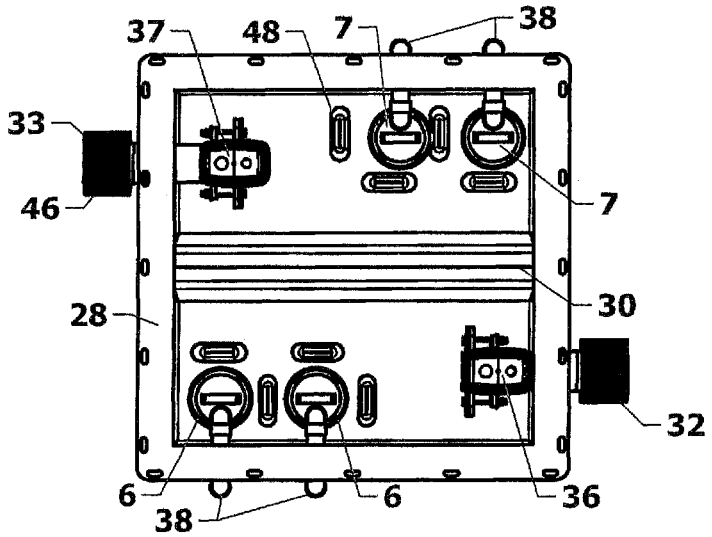
FIG. 9 is a top plan view of the pump housing and pump construct of FIG. 8.

FIGS. 8 and 9 show the pump housing 28 that contains the pump construct. In a preferred embodiment, a ridge 30 is formed that bisects the pump housing. The ridge in this embodiment does not extend to the top of the pump housing. The pumps 6 on one side of the ridge communicate with the flotation containers positioned in the rear portion of the boat lift, and the pumps positioned on the opposite side of the ridge communicate with the flotation containers positioned in the front portion of the boat lift. The ridge inhibits water exchange between sides of the housing by preventing water exchange between sides of the housing until water in the housing rises above the ridge. The ridge is preferred to have a height that is one-half (½) to three-quarters (¾) of the height of the pump housing, and is more preferred to be about two-thirds (⅔) of the height of the pump housing.

Pump locating tabs 48 may be used to position and hold pumps 6,7 in the proper location within pump housing 28. The pump locating tabs 48 may be formed in the pump housing 28. Water transfer hoses 10 connect to the pump housing 28 using water transfer holes 52. Vent lines 22 connect to the pump housing 28 using ventilation holes 54.

As shown in the embodiment of FIG. 1, four (4) pumps are contained in the pump housing 28. Two (2) pumps 6 communicates with the flotation containers 4 located in the front portion of the boat lift. Two (2) pumps 7 that are positioned on the opposite side of the ridge 30 communicate with flotation containers positioned in the rear portion of the boat lift. The pumps are connected to their associated flotation tanks by conduits such as water transfer hoses 10.

The pump housing as shown in FIG. 9 has a first water inlet 32*f* and a second water inlet 32*r* that permit water to enter the pump housing. The first water inlet is positioned on one side of the ridge 30 of the pump housing 28, and the other inlet is positioned on the opposite side of the ridge of the housing. A filter or inlet strainer 46 is preferred to be used to prevent undesirable debris from entering the pump housing. Valves 36, 37 may be associated with the water inlets to open and close the water inlets of the pump housing. When lowering the boat lift, lift valves 36,37 receive a signal to open, allowing water to enter the pump housing 28 through inlets 32, 33. Water flows freely out to the floatation containers through water transfer hose 10. When the water level rises to above the top of ridge 30 water is communicated to all floatation containers that are connected to the pump housing 28. In another embodiment each flotation container of the plurality of flotation containers has a valve that allows water to control water flow into the flotation container.

The use of a plurality of flotation containers 4 overcomes a problem associated with using large flotation containers, such as a pair of longitudinal containers that run the entire length of the boat lift on each side of the boat lift. Such a configuration can cause the boat lift to become unbalanced if sudden weight changes occur, since additional weight placed on an end of an elongated container that is partially full of water can cause the longer flotation container to tilt with the water flowing into, for example, the front portion of the boat lift, and creating an imbalance. The use of individual flotation containers prevents sudden movement of water from one end of a longitudinal flotation container to the other and prevents an imbalance.

The boat lift is preferred to have a level sensor that measures the attitude of the boat lift and senses when the boat lift is not level within a specified number of degrees (level sensor setpoint) measured from front to rear. If the boat lift is not level during a lowering operation, such that the level sensor setpoint is exceeded, the valve communicating with the end of the boat lift that is lower (front or rear) will close so that the associated tanks do not continue to receive water. The end of the boat lift that is higher (front or rear) continues to receive water. When the boat lift reaches a leveled state that is below the level sensor setpoint, the valve that closed will reopen, and normal lowering of the lift continues. If, during the process of raising the boat lift, the level sensor measures that the boat lift is not level within the set point of the sensor, the pump(s) on the higher end terminate operation to allow the opposite or lower end to achieve increased flotation relative to the higher end. When the boat lift is level within the settings of the level sensor, the pumps on the formerly higher end resume operation to raise the boat lift to the desired height according to normal operations.

The use of the plurality of flotation containers, with individual flotation containers 4 on the front portion of the boat lift and on the rear portion of the boat lift, and also individual flotation containers on the left side and right side of the boat lift, allow for leveling the boat lift front and rear and also right and left. The four (4) flotation containers in each quadrant of the boat lift as shown in FIG. 1 may communicate with pumps that allow for leveling the boat lift front and rear and from side to side. Pumps and valves may be dedicated to each quadrant to control flotation levels in each individual quadrant, and a level sensor or sensors measures the attitude of the boat lift in the x and y axes.

Figure 5:
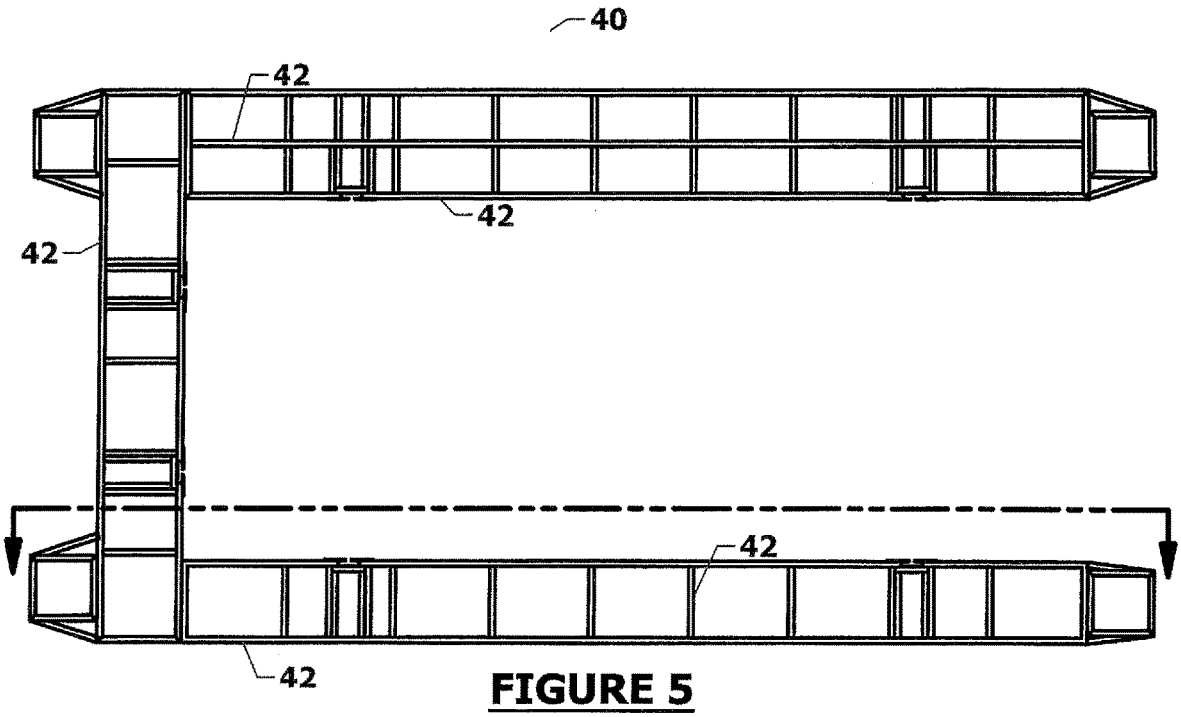
FIG. 5 is a top plan view of the frame of the catwalk formed as a grid.
Figure 6:
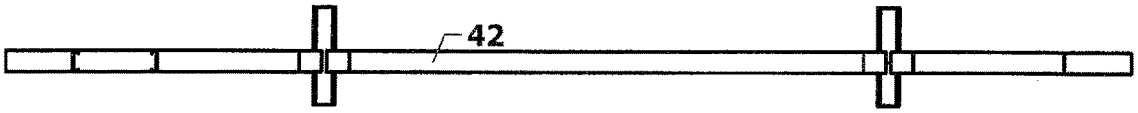
FIG. 6 is a sectioned view of the catwalk taken essentially along line 6-6 of FIG. 5.

In a preferred embodiment, a catwalk 8 is associated with the boat lift. As with the boat lift, the frame 40 of the catwalk is formed in a grid or lattice comprising a framework of structural members 42 that cross each other. FIG. 5. The catwalk frame provides structural support for the decking and a frame to mount the floatation containers 44 to. The floatation containers 44 are attached to the bottom of the catwalk frame 40. The catwalk frame 40 is preferred to be formed of a corrosion resistant and rigid material like the boat lift frame, such as aluminum. It is not necessary for the catwalk to be raised and lowered during use of the boat lift. Therefore, the floatation containers for the catwalk can be generally empty, sealed containers or they may be filled with foam or other floatation materials.

In one embodiment, the floatation containers 44 are partially filled with water so that they float to a desired level. The flotation containers may have an opening into which to place water, with a cap or other closure to close the flotation container after filling with water. It is generally not necessary to change the water level in the floatation containers of the catwalk on a frequent basis, if at all.

In use, the pumps 6, 7 evacuate water from the pump housing 28 and the plurality of flotation containers 4 so that the boat lift sufficiently floats to hold the floating dock, and a boat positioned on top of the floating dock, out of the water. Water is evacuated from the plurality of containers through the associated conduits such as water transfer hoses 10 and out of the pump housing 28 through discharge tubes 38 in the pump housing. The boat lift is lowered so that the boat can exit the boat lift by actuating valves 36, 37 which allows water to flow into the pump housing 28 and into the flotation tanks until the specific gravity of the boat lift construct (which does not include the catwalk) is above 1.0. When sufficient water is present in the flotation tanks so that the boat is floating in the body of water in which it is located without interference from the boat lift, valves 36, 37 may be closed.

Water is used as ballast to raise and lower the lift based on signals to the pumps 6,7 and valves 36,37 that are initiated by the operator. In use, the pumps evacuate water from the flotation containers 4 so that the flotation containers float to raise the boat lift. An actuator switch may be used to provide an electrical or pneumatic signal to open the valves to enter the flotation tanks and lower the boat lift. Another switch or switch position may be used to provide an electrical, hydraulic or pneumatic signal to actuate the pumps and evacuate water from the flotation tanks to raise the boat lift. The valves are closed as the pumps evacuate water from the flotation tanks, and remain closed while the boat lift is in the raised position so that water does not enter the flotation tanks. The system is closed to water entering the housing 28 and the flotation containers while the boat lift is in the raised position.

The valves 36,37 allow water to flow into the flotation containers 4 to lower the boat lift. The pumps 6,7 may be electrically, pneumatically or hydraulically powered. In one embodiment the pumps pump water out of the flotation containers to evacuate the flotation containers. In another embodiment, pumps force air into the flotation containers, forcing water out of the flotation containers through vents, such as vents 22.

The boat lift and catwalk are held in position by piles that extend through pile guides 50. The piles and pile guides allow vertical movement of the boat lift as it is used in operation and allow the boat lift and catwalk construct to float at different levels due to changes in water level from tides and for other reasons. The piles and pile guides prevent substantial horizontal movement of the boat lift and catwalk.

What is claimed:

1. A boat dock, comprising:

a frame formed as a grid and comprising structural members that cross each other;

a plurality of flotation containers connected to the frame and positioned on a forward and left portion of the frame;

a plurality of flotation containers connected to the frame and positioned on a forward and right portion of the frame;

a plurality of flotation containers connected to the frame and positioned on a rear and left portion of the frame;

a plurality of flotation containers connected to the frame and positioned on a rear and right portion of the frame;

a plurality of pumps that communicate with the plurality of flotation containers positioned on the forward and left portion of the frame, the plurality of flotation containers positioned on the forward and right portion of the frame, the plurality of flotation containers positioned on left and rear portion of the frame and the plurality of flotation containers positioned on right and rear portion of the frame;

wherein, in use, the plurality of pumps evacuate water from the plurality of flotation containers positioned on the forward and left portion of the frame, the plurality of flotation containers positioned on the forward and right portion of the frame, the plurality of flotation containers positioned on left and rear portion of the frame and the plurality of flotation containers positioned on right and rear portion of the frame and wherein the plurality of containers and the frame have a specific gravity of less than 1.0 when all of the plurality of containers are purged of water by the plurality of pumps.

2. A boat dock as described in claim 1, further comprising a valve that opens to allow water to enter the plurality of flotation containers positioned on the forward and left portion of the frame, the plurality of flotation containers positioned on the forward and right portion of the frame, the plurality of flotation containers positioned on left and rear portion of the frame and the plurality of flotation containers positioned on right and rear portion of the frame.

3. A boat dock as described in claim 1, further comprising a plurality of valves that open to allow water to enter the plurality of flotation containers positioned on the forward and left portion of the frame, the plurality of flotation containers positioned on the forward and right portion of the frame, the plurality of flotation containers positioned on left and rear portion of the frame and the plurality of flotation containers positioned on right and rear portion of the frame.

4. A boat dock as described in claim 1, wherein the plurality of pumps are positioned within a housing.

5. A boat dock as described in claim 1, wherein the plurality of pumps are positioned within a housing and the housing is positioned between the plurality of flotation containers positioned on the forward portion of the frame and plurality of flotation containers positioned on the rear portion of the frame.

6. A boat dock as described in claim 1, further comprising a first valve that opens to allow water to enter a first side of a housing, wherein the first side of the housing communicates with the plurality of flotation containers positioned on the forward and left portion of the frame and the plurality of flotation containers positioned on the forward and right portion of the frame and a second valve that opens to allow water to enter a second side of the housing, wherein the second side of the housing communicates with the plurality of flotation containers positioned on the rear and left portion of the frame and the plurality of flotation containers positioned on the rear and right portion of the frame.

7. A boat dock as described in claim 1, further comprising a first valve that opens to allow water to enter a first side of a housing, wherein the first side of the housing communicates with the plurality of flotation containers positioned on the forward and left portion of the frame and the plurality of flotation containers positioned on the forward and right portion of the frame and a second valve that opens to allow water to enter a second side of the housing, wherein the second side of the housing communicates with the plurality of flotation containers positioned on the rear and left portion of the frame and the plurality of flotation containers positioned on the rear and right portion of the frame and wherein a first pump of the plurality of pumps is positioned on the first side of the housing and a second pump of the plurality of pumps is positioned on the second side of the housing.

8. A boat dock as described in claim 6, wherein the housing has a ridge formed therein, and wherein the ridge divides the housing into the first side of the housing and the second side of the housing, and a first pump of the plurality of pumps is positioned on the first side of the housing and the second pump of the plurality of pumps is positioned on the second side of the housing, and wherein the ridge inhibits water exchange between sides of the housing.

9. A boat dock as described in claim 7, wherein the housing has a ridge formed therein, and wherein the ridge divides the housing into the first side of the housing and the second side of the housing, and a first pump of the plurality of pumps is positioned on the first side of the housing and the second pump of the plurality of pumps is positioned on the second side of the housing, and wherein the ridge inhibits water exchange between sides of the housing, and wherein the first valve allows water to flow exclusively to the first side of the ridge when a level of water in the first side is below the ridge.

10. A boat dock as described in claim 1, wherein the plurality of flotation containers positioned on the forward and left portion of the frame, the plurality of flotation containers positioned on the forward and right portion of the frame, the plurality of flotation containers positioned on left and rear portion of the frame and, the plurality of flotation containers positioned on right and rear portion of the frame are positioned under the frame.

11. A boat dock as described in claim 1, further comprising a level sensor that selectively actuates a pump of the plurality of pumps to evacuate water from the plurality of flotation containers positioned on the forward and left portion of the frame and the plurality of flotation containers positioned on the forward and right portion of the frame upon the level sensor sensing that the frame of the boat dock is more than a predetermined number of degrees from level.

12. A boat dock as described in claim 1, further comprising a level sensor that controls a pump of the plurality of pumps to terminate evacuation of water from the plurality of flotation containers positioned on the forward and left portion of the frame and the plurality of flotation containers positioned on the forward and right portion of the frame upon the level sensor sensing that the frame of the boat dock is more than a predetermined number of degrees from level.

13. A boat dock as described in claim 1, further comprising a level sensor that selectively actuates a pump of the plurality of pumps to evacuate water from the plurality of flotation containers positioned on the rear and left portion of the frame and the plurality of flotation containers positioned on the rear and right portion of the frame upon the level sensor sensing that the frame of the boat dock is more than a predetermined number of degrees from level.

14. A boat dock as described in claim 1, further comprising a level sensor that controls a pump of the plurality of pumps to terminate evacuation of water from the plurality of flotation containers positioned on the rear and left portion of the frame and the plurality of flotation containers positioned on the rear and right portion of the frame upon the level sensor sensing that the frame of the boat dock is more than a predetermined number of degrees from level.

15. A boat dock a described in claim 1, wherein the plurality of flotation containers are formed of polyethylene.

16. A boat dock as described in claim 1, wherein a top surface of the frame is substantially flat.

17. A boat dock as described in claim 1, wherein a bottom surface of the frame is substantially flat, and all of the plurality of containers are attached to the bottom surface of the frame.

* * * * *